US007727118B1

(12) United States Patent
McCall

(10) Patent No.: US 7,727,118 B1
(45) Date of Patent: Jun. 1, 2010

(54) ROCK CLIMBING SIMULATOR APPARATUS

(76) Inventor: Terry D. McCall, 318 Southview Dr., Strasburg, PA (US) 17579

( * ) Notice: Subject to any disclaimer, the term of this patent is extended or adjusted under 35 U.S.C. 154(b) by 0 days.

(21) Appl. No.: 11/828,152

(22) Filed: Jul. 25, 2007

(51) Int. Cl.
*A63B 22/14* (2006.01)

(52) U.S. Cl. ..... 482/37; 482/112; 482/51

(58) Field of Classification Search ..... 482/110, 482/146–147, 51, 142, 37
See application file for complete search history.

(56) References Cited

U.S. PATENT DOCUMENTS 519,178 A * 5/1894 Douglas et al. ..... 211/163
583,661 A * 6/1897 Smith ..... 119/700
1,916,809 A * 7/1933 Patterson ..... 472/14
2,193,154 A * 3/1940 Amilio ..... 248/458
2,467,338 A * 4/1949 Sellards ..... 472/18
2,646,281 A * 7/1953 Hurst ..... 472/14
3,084,935 A * 4/1963 Brown ..... 472/26
3,481,599 A * 12/1969 Johnson ..... 472/18
3,604,722 A * 9/1971 Boley ..... 280/87.01
3,649,007 A * 3/1972 Thomas ..... 472/26
3,785,641 A * 1/1974 Muffly ..... 472/40
4,193,592 A * 3/1980 Bishow ..... 472/14
4,289,306 A * 9/1981 Thomas ..... 472/26
4,568,079 A * 2/1986 Stark ..... 472/14
4,613,131 A * 9/1986 Anderson ..... 482/146
4,848,742 A * 7/1989 Lindley et al. ..... 482/142
4,923,191 A * 5/1990 Persico ..... 482/52
D316,889 S * 5/1991 Smith ..... D21/830
5,076,574 A 12/1991 Johnson, Jr.
5,092,587 A * 3/1992 Ulner et al. ..... 482/37
5,125,877 A * 6/1992 Brewer ..... 482/7
5,145,475 A * 9/1992 Cares ..... 482/52
5,203,279 A * 4/1993 Eversdyk ..... 119/712
5,352,166 A * 10/1994 Chang ..... 482/52
5,543,185 A 8/1996 Christensen
5,549,195 A * 8/1996 Aulagner et al. ..... 198/850
5,732,954 A * 3/1998 Strickler et al. ..... 273/441
5,803,880 A * 9/1998 Allen ..... 482/113
5,810,703 A * 9/1998 Stack ..... 482/146
5,997,403 A * 12/1999 Fonti ..... 472/19
6,083,142 A * 7/2000 Wilson ..... 482/37
6,095,952 A * 8/2000 Ali et al. ..... 482/54
6,231,482 B1 * 5/2001 Thompson ..... 482/37
6,342,030 B1 * 1/2002 Lazik ..... 482/37
6,390,952 B1 * 5/2002 Wilson ..... 482/37
6,402,663 B1 * 6/2002 Popp ..... 482/35
6,413,197 B2 * 7/2002 McKechnie et al. ..... 482/146
6,428,451 B1 * 8/2002 Hall ..... 482/146
6,551,216 B2 * 4/2003 Rennex ..... 482/35
6,699,158 B1 * 3/2004 Richardson et al. ..... 482/37
6,719,290 B1 * 4/2004 Kershner ..... 273/272
6,860,836 B1 * 3/2005 Wu ..... 482/37
6,872,167 B1 * 3/2005 Meissner ..... 482/37
6,892,676 B2 * 5/2005 Mazrolle et al. ..... 119/753
D513,353 S * 12/2005 Pederson ..... D34/28

(Continued)

*Primary Examiner*—Steve R Crow
*Assistant Examiner*—Robert F Long
(74) *Attorney, Agent, or Firm*—Andrew D. Mead

(57) ABSTRACT

An improved rock climbing simulator that uses an adjustable fluid resistance apparatus coupled to an axle of a rotating climbing surface to control the rate of rotation of the climbing surface and thus the perceived climbing speed experienced by the climber. The fluid resistance apparatus is structured to control the rate of rotation of the climbing surface, and hence the perceived climbing speed, regardless of the weight or position of a climber on the climbing surface.

18 Claims, 3 Drawing Sheets

U.S. PATENT DOCUMENTS

| | | | | |
|---|---|---|---|---|
| 7,018,323 | B1 | 3/2006 | Reynolds et al. | |
| 7,195,582 | B2 * | 3/2007 | Wu | 482/37 |
| 7,287,755 | B1 * | 10/2007 | Kershner | 273/272 |
| 7,357,757 | B2 * | 4/2008 | Brown | 482/37 |
| 7,578,745 | B2 * | 8/2009 | Wingerstahn | 472/18 |
| 2002/0169052 | A1 * | 11/2002 | Godsey | 482/37 |
| 2006/0019798 | A1 * | 1/2006 | Checketts et al. | 482/35 |
| 2007/0033867 | A1 * | 2/2007 | Henry et al. | 47/40.5 |
| 2007/0254779 | A1 * | 11/2007 | Vanamo | 482/35 |
| 2009/0137328 | A1 * | 5/2009 | Wingerstahn | 472/14 |

* cited by examiner

ROCK CLIMBING SIMULATOR APPARATUS

BACKGROUND OF THE INVENTION

The present invention relates generally to rock climbing simulators, and, more particularly to climbing simulators such devices whose climbing surface rotates in such a manner so that as the climber begins to climb on the device and attempts to ascend, the rotation of the device's climbing surface moves in a descending direction at a rate of speed equal to the climbers ascent thus countering the climbers attempt to ascend and thus keeps the climber in a safe proximity to the floor or ground.

Interest in climbing as a beneficial means to maintain or improve fitness has steadily grown. Benefits of climbing include muscular and skeletal strengthening, endurance, balance, flexibility, cardiovascular, and eye hand coordination. Fitness clubs and centers realize the value of incorporating climbing into the exercise activities they provide. The most common means for providing rock climbing for fitness enthusiasts is with climbing walls. The problem with climbing walls is they require walls with heights in excess of 30 feet. In addition, the climber of these high climbing walls is required to put on a safety harness. A trained attendant must monitor the harnessing of the climber and the climb itself. The requirement of high walls and trained personnel to monitor the activity makes rock climbing walls prohibitive for most fitness facilities.

In response to the demand for safer and less personnel intensive climbing systems, two types of rock climbing simulators have been developed to provide climbers a harness-free, safe climbing experience. The first is characterized as having a vertically oriented conveyor belt to which rock climbing holds are affixed. U.S. Pat. Nos. 8,231,482 by Thompson and 6,860,836 by Wu are representative examples of this type of climbing simulator. The second type of climbing simulator is characterized as a rotating disk or wheel having a vertically oriented planar surface to which climbing holds are affixed. U.S. Pat. No. 6,342,030 by Lazik is a representative example of this type of simulator.

In both types of simulators, control of the motion of the climbing surface is critical to providing a safe climbing simulation. It is well known to use an electric motor controlled by programmable electronics to control the speed of motion of the climbing surface. The shortcoming of electric motor control is that while a near-constant climbing speed is provided, motion continues irrespective of the presence of a climber. The simulation effect is less than desirable if a climber pauses while on the simulator as the motor will continue to move the surface, forcing the climber to either resume climbing or step off the simulator. Additionally, the selected speed may be uncomfortable for the climber who is unable to vary the speed without readjusting the apparatus.

It is desirable in the fitness industry to use potential and kinetic energy of the fitness enthusiast rather than electrically operated apparatus. Electrified fitness equipment presents a host of safety concerns for the fitness facility, adds additional demand on the facility's utilities, and contributes both heat and noise to the facility environment. Additionally, electrical devices relying upon electronic controls are susceptible to power surges and malfunctions which may render the device inoperative until repairs can be effected. As a result, fitness facilities prefer to the extent possible to use fitness equipment that is non-electric in nature and having a minimal number of components. Ideally, fitness equipment should take the exerted energy of the fitness enthusiast and offer resistance sufficient to provide a healthy and safe workout.

Devices taking advantage of the enthusiast's potential and kinetic energy impose additional challenges on the designers of disk-shaped climbing simulators. As the climber weight is placed on the free spinning climbing surface, the surface tends to move quickly in a direction opposite the direction of ascent of the climber. Left unrestrained, the climbing surface may spin out from underneath the climber. A simple braking system or similar friction-based resistance is complicated by the fact that that individual climber may differ in weight, thus requiring varying amount of resistance. The rotating disk climbing simulators present additional challenges to applying optimal rotational resistance as the climber moves laterally along a radius of the rotating surface thereby changing the torque being generated by the climber. Designing a resistance system which resists that torque yet allows for optimal rotational speed of the climbing surface that is conducive to safe climbing is complicated. Known disk-shaped climbing simulators control the rate of rotation of the climbing surface by utilizing an electric motor to drive the simulator at a speed determined through electronic controls.

It would be a great advantage in the competitive market for fitness equipment to provide a rock climbing simulator that is simple in design, construction, and use. Further advantages would be realized by providing a climbing simulator having minimal moving parts and free of electric motors and electronic controls. Still further advantages would be realized by providing a climbing simulator that is suitable for indoor or outdoor use.

SUMMARY OF THE INVENTION

Accordingly, it is an object of the present invention to provide a climbing simulator having a climbing surface resembling a rock climbing wall.

It is another object of the present invention to provide a rock climbing simulator that minimizes safety concerns to the climber by limiting the distance above the ground the climber may ascend during the simulation.

It is another object of the present invention to provide a climbing simulator that relies on the weight of the climber to cause motion of the climbing surface.

It is another object of the present invention to provide a climbing simulator in which rotational motion of the climbing surface caused by the climber interacting with the climbing surface is resisted by a resistance apparatus to control the rotational speed of the simulator and maintain a safe climbing environment for the climber.

It is a further object of the present invention to provide a rock climbing simulator for which the angle of inclination for climbing may be adjusted to suit varying levels of user climbing skill.

It is a further object of the present invention to provide a rock climbing simulator that is compact in construction allowing installation and use with minimal floor space or ceiling height.

It is a further object of the present invention to provide a rotating disk rock climbing simulator surface which enables near-constant rotational speed regardless of the climbers radial position on the climbing surface.

It is a still further object of the present invention to provide an improved rock climbing simulator having simplified construction and minimal moving parts.

It is a still further object of the present invention to a climbing simulator that is suitable for indoor or outdoor use.

It is a still further object of the present invention to provide a climbing simulator that is simply adjusted and safely operated thereby eliminating the need for an attendant.

It is a still further object of the present invention to provide a rock climbing simulator that is durable in construction, inexpensive of manufacture, carefree of maintenance, easily assembled, and simple and effective to use.

These and other objects are achieved by providing an improved rock climbing simulator that uses an adjustable fluid resistance apparatus coupled to the axle of a rotating climbing surface to control the rate of rotation of the climbing surface and thus the perceived climbing speed experienced by the climber.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "left" or "right," "up" or "down," or "top" or "bottom" are used as a matter of mere convenience, and are determined by standing facing the apparatus in a direction of normal use. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail. When referring to the figures, like parts are numbered the same in all of the figures.

Rock climbing simulators of the type in which the present invention is advantageous, comprise a generally vertically oriented substantially planar rotating climbing surface mounted to a fixed structure. Rotational of the climbing surface is caused by the weight of the climber applied to the climbing surface at a distance radially displaced from the rotational axis of the climbing surface, that is the climbers weight applied through a moment arm creates a torque which in turn rotates the climbing surface. In order to provide a safe climbing simulation, the rate at which the climbing surface is allowed to rotate much be controlled.

Figure 1:
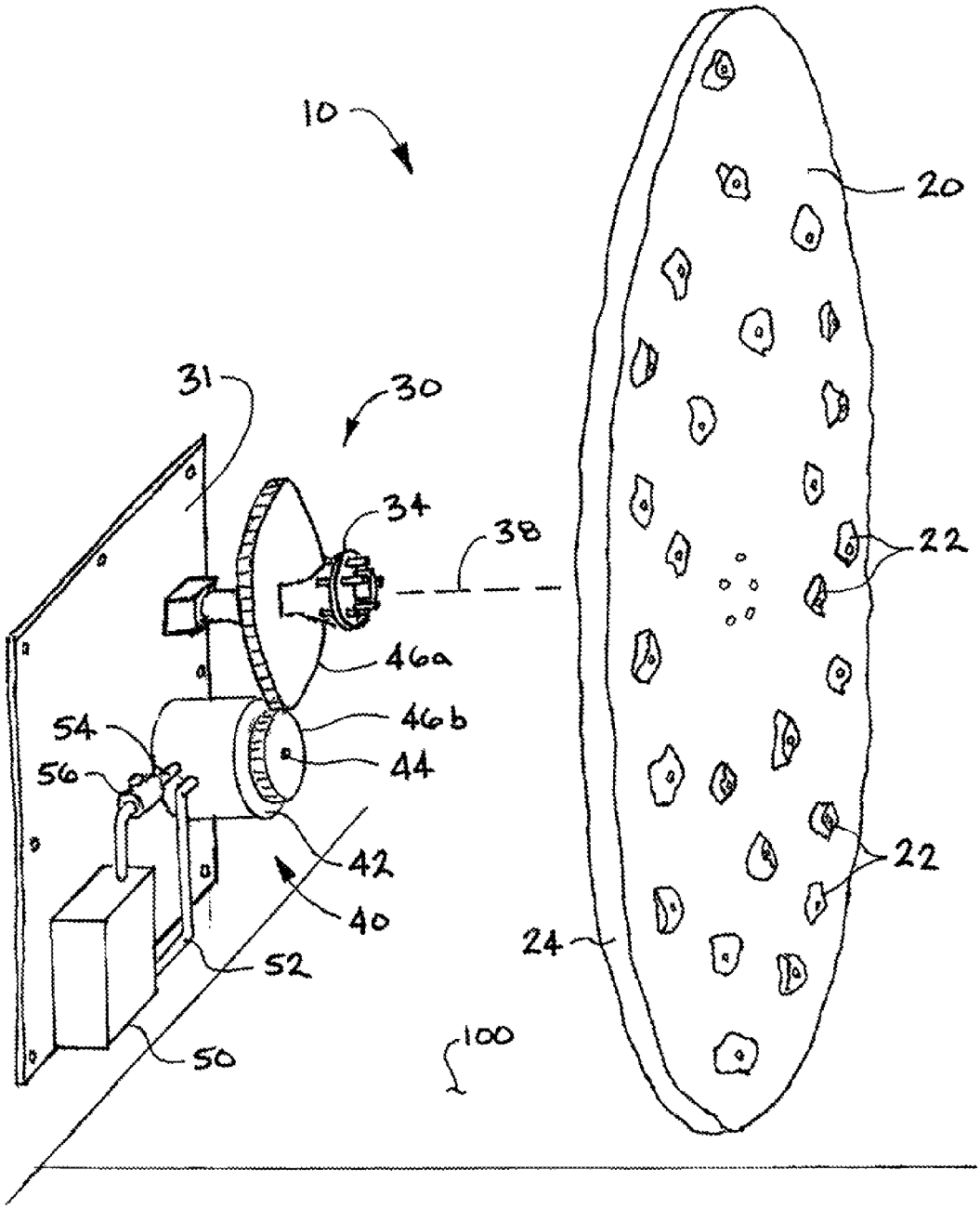
FIG. 1 is a front side perspective view of one embodiment of the present invention.
Figure 2:
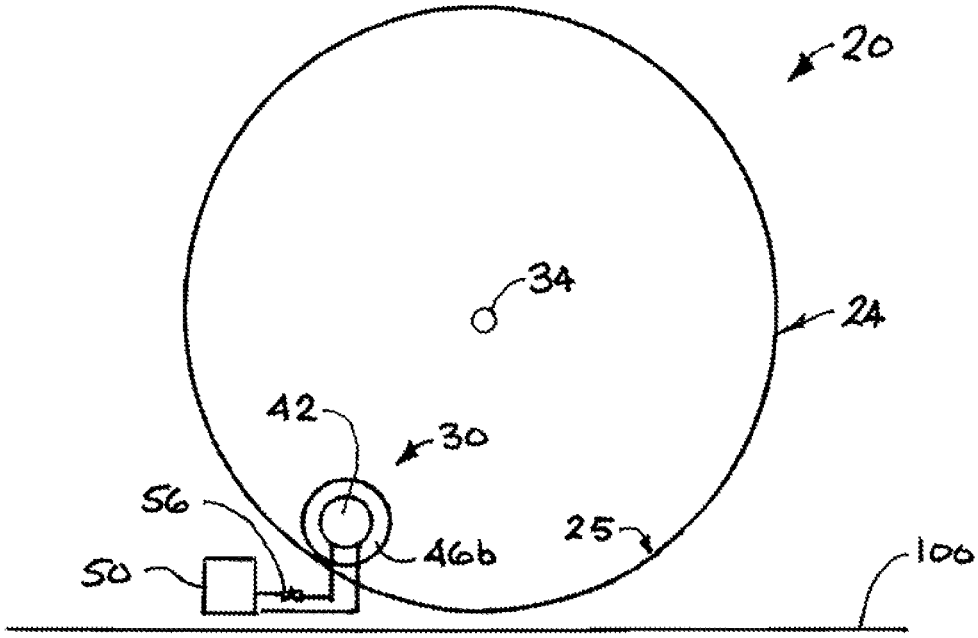
FIG. 2 is a rear elevation view of a first alternate embodiment of a drive mechanism for the present invention.

Referring first to FIGS. 1 and 2, an exercise apparatus 10 is shown having an exercise surface 20 rotationally coupled to a drive apparatus 30. In a first embodiment, drive apparatus 30 is connected to frame 31 and functions to provide both structural support for exercise surface 20 and to transfer rotational motion of the climbing surface 20 to the resistance mechanism 40. In such an embodiment, shaft 34 is connected to frame 31, as shown, which allows the exercise surface 20 to rotate about an axis 38 thus enabling climbing surface 20 to rotate similar to a large wheel. In an alternate embodiment, shown in. FIG. 2, drive apparatus 30 may be separate from shaft 34 such that shaft 34 provides the structural support for the climbing surface 20 while the rotational motion is transferred through another means whereby gear 46*a* is alternatively coupled to the exercise surface. In such an embodiment of drive apparatus 30, pump input shaft 44 (not shown in FIG. 2) is rotationally coupled to an interior perimeter 25 of the exercise surface using a geared or friction contact to convert exercise rotation to rotational input to a shaft. Alternatively, the point of engagement could also be with an outer perimeter 24 of the exercise surface 20, but such an embodiment would require additional space for the exercise apparatus and would create a potential pinch point hazard for users at the point of contact between the exercise surface 20 and the drive mechanism 30.

Exercise surface 20 is a generally circular planar structure and includes a plurality of protrusions 22 from the surface which provide foot and hand holds for a climber to use engaged in a climbing simulation. The protrusions may be individually formed and affixed to the exercise surface 20, or they may be integrally molded into the surface of exercise surface to more realistically portray a rock face. Protrusions 22 are arranged in a random pattern in a radial zone generally adjacent to the perimeter of exercise surface 20. Exercise surface 20 is of sufficient diameter to allow a person to engage the protrusions with their hands and/or feet and reach above to engage protrusions positioned overhead to simulate climbing, generally on the order of eight to ten feet in diameter. As the climber pulls himself/herself upward, rotation of the exercise surface 20 allows the climber to remain in a relatively stationary vertical position as the climbing surface passes, providing, in effect, a rotary treadmill.

Left unrestrained, free rotation of exercise surface 20 would provide difficult and dangerous conditions for the participant. To this end, a resistance mechanism 40 is provided to control the rate of rotation of exercise surface 20 (and thus the perceived climbing speed) to one which the participant can safely traverse. In the preferred embodiment, resistance mechanism 40 includes a positive displacement hydraulic pump 42 having an input shaft 44 rotationally coupled to exercise surface 20 by drive mechanism 30. In one embodiment shown in FIG. 1, drive mechanism 30 includes a pair of intermeshing gears 46*a*, 46*b*, one gear connected to shaft 34 which is rotated by exercise surface 20, and the other connected to pump input shaft 44. Other methods for rotationally coupling shaft 34 and pump input shaft 44 include belts and pulleys, chains and sprockets, and the like. Alternatively, shaft 34 and pump input shaft 44 may be directly coupled along axis 38 using a shaft coupling, though this alternative eliminates the ability to alter the ratio of shaft 34 rotation speed to pump input shaft 44 rotation speed.

Figure 3:
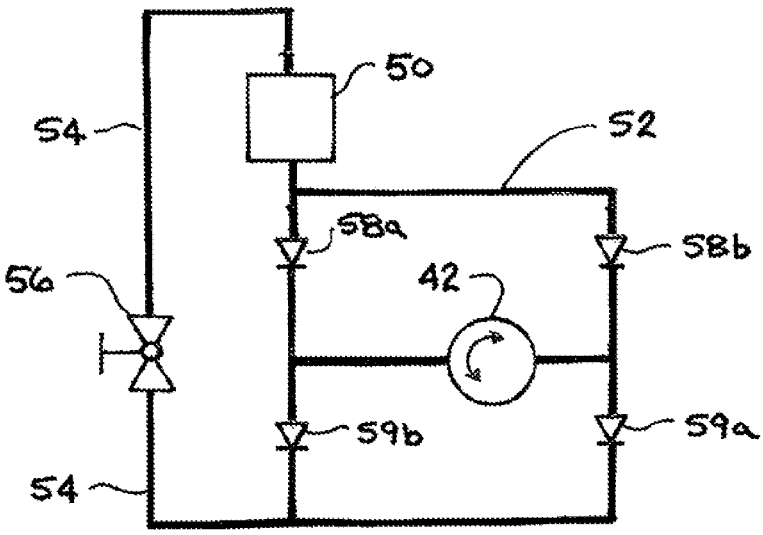
FIG. 3 is a schematic diagram of one embodiment of a resistance mechanism of the present invention.

Rotation of pump 42 causes movement of a hydraulic fluid through a closed loop system comprising a reservoir 50, a supply line 52, a return line 54, and a throttle 56. Referring now to FIG. 3, a diagram of the resistance mechanism is provided to illustrate the how the flow of circulating fluid restrains motion of the climbing surface while allowing the apparatus to be used by rotation of climbing surface 20 in either direction. Pump 42 is a positive displacement hydraulic pump having a rotational input, as a shaft. Rotation of the shaft results in a flow of fluid through the pump in direct proportion to the speed at which the shaft is rotated. Fluid flow through the pump is also directional, based upon the direction the input shaft is rotated. Supply line 52 receives fluid from reservoir and is supplied to the suction side of the pump 42, which could be either connection depending upon the direction of rotation. Input check valves 58*a*, 58*b* assure that flow to the pump 42 is provided to the suction side connection. The input check valve on the discharge side of the pump will isolate to prevent reverse flow since the discharge pressure of the pump be greater than the suction side pressure. Flow discharge is directed through one of the output check valves 59*a* or 59*b* and directed to throttle 56. As with the suction side arrangement, the discharge check valves 59*a*, 59*b* will allow the discharge flow to pass, but will prevent the discharge from being recirculated to the pump suction side. As shown in FIG. 3, fluid flow will be through the "a" check valves with "b" valves isolating, or through the "b" valves with the "a" valves isolated.

Throttle 56 is an adjustable valve allowing the fluid flow rate through the valve to be adjusted. Since the rate of fluid flow is directly related to the speed of rotation of pump 42, throttle 42 allows the speed of rotation of the pump 42 and hence climbing surface 20 to be controlled through variation in the setting of the throttle 42. The characteristics of throttle 42 may also be selected such that variations in fluid pressure do not have significant affect on the flow rate through the valve. In this manner, the torque into the resistance unit has little effect on the fluid flow rate through the valve. Thus, a user's position on climbing surface 20 will have little effect on the rotational speed of the climbing surface. Essentially, the resistance unit is adjusted to provide a desired maximum rotational speed. Once set, the resistance mechanism 40 will maintain the rotational speed of the climbing surface at or below that setting regardless of the climber's weight or position on the climbing surface.

Figure 4:
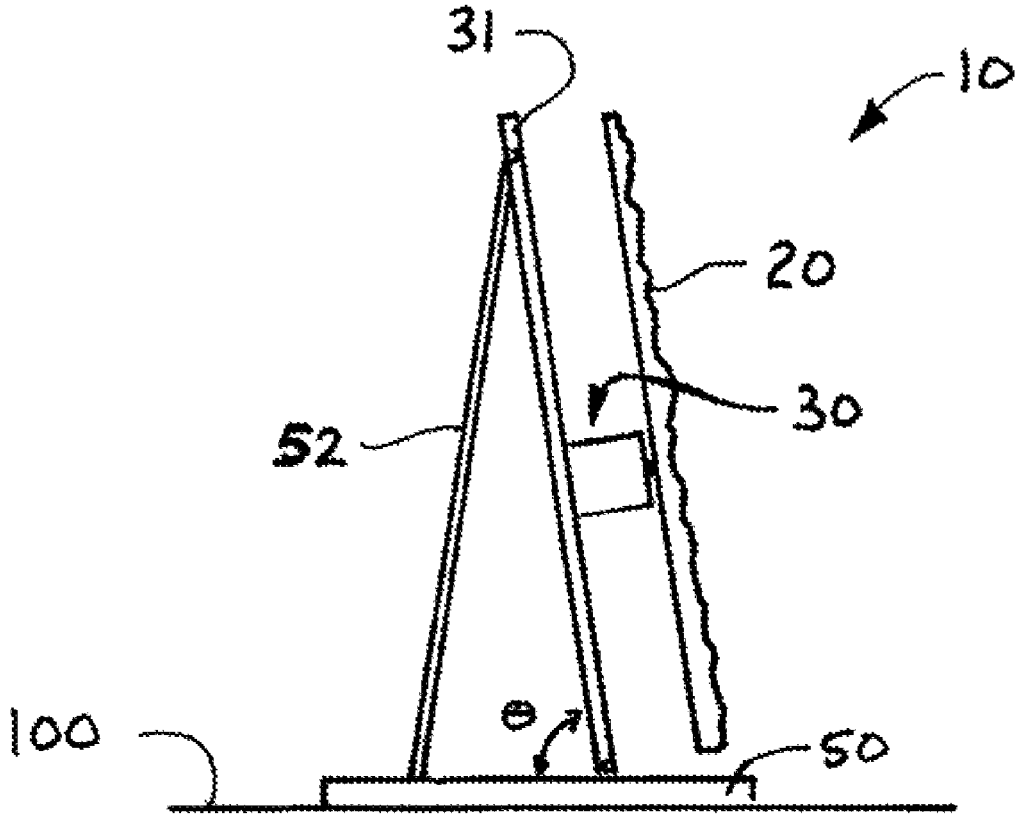
FIG. 4 is a side elevation view showing one embodiment of the climbing apparatus for which the climbing angle has been adjusted.

Finally referring to FIG. 4, an illustration of an alternate embodiment of the invention is shown wherein the angle of the climbing surface is altered. As preferably constructed, the frame 31 is attached to a wall or other similar structure. This preference allows the exercise apparatus 10 to be economically installed in a variety of locations. It may be necessary to provide a freestanding frame in other installations. This is permissible since the drive apparatus 30 and resistance mechanism 40 are sufficiently compact in nature and do not require complicated mechanical or electrical connections with either the climbing surface or the ground. As shown, one embodiment includes a base 50, frame 31, and a brace 52. By pivotally connecting frame 31 to base 50, the angle of inclination (shown as Θ in FIG. 4) of climbing surface 20 may be altered. One advantage to providing an adjustable angle of inclination is that the exercise apparatus 10 may be adjusted to suit the climbing skill level of a variety of users. By providing a range of adjustment of up to 15 degrees from vertical in either direction, the climbing surface can thus be adjusted to simulate a steep, but not quite vertical incline (as shown in FIG. 4) or a climbing surface which overhangs the climber, greatly increasing the climbing challenge. Adjustments of the angle of inclination within this range are well within the capability of base 50 to be sized to provide a stable foundation for the apparatus without requiring an unreasonably sized base.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention, however, concepts, as based upon the description, may be employed in other embodiments without departing from the scope of the invention.

Having thus described the invention, what is claimed is:

1. A climbing exercise apparatus for a user comprising:

a generally planar and rigid exercise surface of sufficient size for the user to interact therewith in a simulated climbing exercise, said exercise surface being generally vertically oriented and bounded by a perimeter and arranged for rotation about a central axis, said central axis being generally perpendicular to said exercise surface;

a drive mechanism connected to said exercise surface and having an output shaft, said drive mechanism for converting movement of said surface into rotational movement of said output shaft; and a resistance mechanism connected to said output shaft, said resistance mechanism having a positive displacement pump for connection and rotation by said output shaft, a throttle, a circulating loop hydraulically connecting said pump and said throttle, and a circulating fluid disposed within said circulating loop, said throttle being selectively adjustable and acting upon said fluid whereby said resistance mechanism, once adjusted, limits the rate of motion of said exercise surface to a desired maximum rate when the user interacts with said surface.

2. The apparatus of claim 1, wherein said movable surface is a generally circular planar structure having a diameter disposed for rotation about said central axis and said central axis is aligned with said output shaft.

3. The apparatus of claim 2, wherein said exercise surface is rotatable in either of two opposing directions about said central axis.

4. The apparatus of claim 3, wherein said diameter is on the order of eight to ten feet.

5. The apparatus of claim 4, wherein said movable surface further comprises a plurality of protrusions shaped and arranged to facilitate simulated climbing by the user.

6. The apparatus of claim 5, wherein said movable surface may be aligned at an angle relative to a vertical plane.

7. The apparatus of claim 6, wherein said angle ranges between zero and approximately 15 degrees in either direction from vertical.

8. An exercise apparatus simulating climbing on a surface comprising:

a frame for supporting said apparatus;

a generally planar and rigid climbing surface bounded by a perimeter of sufficient size for a user to interact therewith in a simulated climbing exercise, said climbing surface being oriented substantially vertically;

an axle supported by said frame, said axle connected to said climbing surface and oriented generally perpendicular thereto thereby enabling said climbing surface to rotate in either of two opposing directions about said central axis; and a resistance mechanism connected to said axle, said resistance mechanism having a positive displacement hydraulic pump for circulating a working fluid in a closed loop responsive to rotation of said axle and an adjustable throttle disposed in said closed loop for regulating a rate of fluid flow in said loop, wherein a rate of rotation of said climbing surface, when said apparatus is in use, is limited to a desired maximum rate by adjustment of said throttle when the user interacts with said climbing surface.

9. The apparatus of claim 8, wherein said climbing surface is a generally circular structure having a diameter centered disposed for rotation about said axle.

10. The apparatus of claim 9, wherein said diameter is on the order of eight to ten feet.

11. The apparatus of claim 10, wherein said climbing surface further comprises a plurality of protrusions shaped and arranged for use as climbing holds.

12. The apparatus of claim 11, wherein said climbing surface may be aligned at an angle in either direction relative to a vertical plane.

13. The apparatus of claim 12, wherein said angle ranges between zero and approximately 15 degrees.

14. A method for controlling the motion of a climbing surface on an exercise apparatus comprising the following steps:

providing a generally rigid planar and vertically oriented movable climbing surface bounded by a perimeter, said climbing surface being of sufficient size for a user to interact therewith in a simulated climbing exercise and rotatable in either direction about an axis normal to the planar surface;

providing an axle connected to the surface and disposed on the axis;

providing a resistance mechanism connected to the axle, the resistance mechanism having a circulating fluid and a throttle, the throttle disposed to regulate the flow of fluid in the mechanism to limit rate of rotation of said surface;

allowing a first user to engage the climbing surface in a manner simulating climbing, the weight of the participant tending to cause the climbing surface to rotate;

circulating the fluid by rotation of the climbing surface transferred via the axle to the resistance mechanism; and adjusting the throttle to provide a resistance to rotation of the climbing surface until a desired rate of rotation of the climbing surface is achieved.

15. The method of claim 14, further comprising the step of adjusting the throttle to increase resistance to achieve a slower climbing speed.

16. The method of claim 14, further comprising the step of adjusting the throttle to decrease resistance to achieve a faster climbing speed.

17. The method of claim 14, further comprising the step of providing a generally circular climbing surface having a diameter on the order of eight to ten feet.

18. The method of claim 17, further comprising the steps of:

allowing a second user to engage the climbing surface after the first user has disengaged from the surface; and adjusting the throttle to provide a resistance to rotation of the climbing surface until a desired rate of rotation of the climbing surface for the second user is achieved.

* * * * *